US006484801B2

(12) United States Patent
Brewer et al.

(10) Patent No.: US 6,484,801 B2
(45) Date of Patent: Nov. 26, 2002

(54) FLEXIBLE JOINT FOR WELL LOGGING INSTRUMENTS

(75) Inventors: James E. Brewer, Houston, TX (US); Borislav Tchakarov, Katy, TX (US); Paul G. Junghans, Houston, TX (US); James C. Hunziker, New Caney, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/810,985

(22) Filed: Mar. 16, 2001

(65) Prior Publication Data

US 2002/0129945 A1 Sep. 19, 2002

(51) Int. Cl.[7] ..... E21B 17/20; H01R 24/02
(52) U.S. Cl. ..... 166/65.1; 166/242.6; 439/194
(58) Field of Search ..... 166/65.1, 242.2, 166/242.6, 254.2; 175/40, 82; 439/191, 192, 193, 194, 195

(56) References Cited

U.S. PATENT DOCUMENTS

| | | | | |
|---|---|---|---|---|
| 2,147,491 A | | 2/1939 | Le Bus | |
| 3,733,853 A | | 5/1973 | Sutliff | |
| 4,375,237 A | * | 3/1983 | Churchman | 166/117.5 |
| 4,457,370 A | | 7/1984 | Wittrisch | |
| 4,489,472 A | * | 12/1984 | Cabrit et al. | 29/426.5 |
| 4,570,709 A | | 2/1986 | Wittrisch | |
| 4,614,250 A | * | 9/1986 | Panetta et al. | 181/102 |
| 4,842,059 A | | 6/1989 | Tomek | |
| 4,901,804 A | | 2/1990 | Thometz et al. | |
| 5,158,397 A | * | 10/1992 | Koos et al. | 405/195.1 |
| 5,389,003 A | * | 2/1995 | Van Steenwyk et al. | 439/191 |
| 5,769,558 A | | 6/1998 | Jekielek | |
| 5,820,416 A | * | 10/1998 | Carmichael | 439/668 |
| 5,836,388 A | | 11/1998 | Tchakarov | |
| 6,116,337 A | * | 9/2000 | Civarolo et al. | 166/65.1 |

* cited by examiner

*Primary Examiner*—Frank S. Tsay
(74) *Attorney, Agent, or Firm*—Madan, Mossman & Sriram, P.C.

(57) ABSTRACT

A universal joint between adjacent, electrically connected instrument housings for downhole well operations allow the connected housings to bend longitudinally as required to traverse an arced section of a well bore but does not permit relative elongation or twisting about the longitudinal axis of the housings. In one embodiment, a fluid impermeable open passage space at atmospheric pressure surrounds electrical signal carriers linking the instrument circuitry within the two housings. The passage is constructed as a high-pressure flexible bellows or as a braided or spiral wound high-pressure fluid hose. In another embodiment, a fluid impermeable sheath surrounds the signal carriers and encapsulates the signal carriers by a resilient solid. The articulation structure comprises a Cardan-type of universal joint wherein two fingers project longitudinally from the end of each of the housings. The fingers are meshed and pivotally joined to respective spindles projecting radially from the open center of a ring spyder. The protective bellows, hose or resilient compound filled sheath is secured at opposite ends to bore plugs in the respective instrument housings. Between the instrument housings, the hose, bellows or filled sheath passes through the open center of the spyder ring.

24 Claims, 6 Drawing Sheets

FLEXIBLE JOINT FOR WELL LOGGING INSTRUMENTS

BACKGROUND OF THE INVENTION

1. Field of the Invention

The present invention relates to downhole well tools. In particular, the invention relates to an articulated joint between adjacent, operatively connected tubular sections of and elongated instrument housing.

2. Description of the Prior Art

For many reasons, a well bore may follow a tortured course having one or more turns; some of relatively short radius. Standard drill pipe length is about thirty feet. Notwithstanding the apparent strength and rigidity of drill pipe, a thirty foot length is capable of considerable flexure. For such reason, a traditional drill string may accurately be perceived as a flexible drive shaft capable of rotation about the longitudinal pipe axis over a relatively small radius of arc. Downhole drill motors supported by coiled tubing are capable of boring even smaller radius arcs.

Generally, downhole well tools are lowered along the inner bore of casing, drill pipe or tubing within a well bore. Consequently, the downhole tool substantially follows the same undulations as the drill string or tubing. However, tool housings, especially electronic measuring or control instruments are not constructed of the same materials as drill string and cannot accommodate the same degree of bending. Nevertheless, some downhole tools such as Measuring While Drilling (MWD) systems or steering tools require substantial total tube length to accommodate the necessary component volume within a relatively small inside diameter. Consequently, the tubular housings for such instruments must be segmented into two or more length sections. Since the two or more length sections are functionally one tool, the several tubular housing sections must communicate to function as a unit. At the same time, the several sections must maintain a relatively consistent angularity about the longitudinal axis between the leading or lower end of the tool and the trailing or upper end of the tool.

U.S. Pat. No. 4,842,059 titled: FLEX JOINT INCORPORATING ENCLOSED CONDUCTORS partially addresses these issues with a double ball-and-socket style of universal joint. To transfer torque about the longitudinal axis of a multiple tube instrument, ball-and-socket joints between the tubes are pinned to prevent relative axial rotation between a ball element and a socket element. Dynamic pressure seals between the ball and the respective socket permits a positive pressure fluid chamber between cable connector plugs respective to each of the two instrument length sections. The positive pressure chamber objective of the '059 disclosure is to protect the electrical continuity and electrically isolate the several signal carrier conduits passing between adjacent instrument section. A spring loaded annular piston maintains the chamber pressure to exclude unwanted fluids.

U.S. Pat. No. 5,836,388 titled FLEXIBLE JOINT FOR DOWNHOLE TOOL and U.S. Pat. No 5,769,558 titled FLEX JOINT both provide sealed, flexible joints between adjacent MWD tool sections. The structural link between adjacent tool sections comprises a pair of wound coil springs encased in an integral rubber boot. The injection molded rubber boot provides electrical insulation and environmental isolation from the borehole. Although the coil springs are capable of transmitting torque from one tool section to the other, the torque is transmitted through a substantial angular displacement. Additionally, the springs permit considerable elongation and contraction between the adjacent tool ends. Moreover, considerable force is required to bend the boot encased spring.

SUMMARY OF THE INVENTION

It is an objective of the present invention to provide a flexible joint between adjacent downhole instrument housings that will neither elongate nor permit significant angular displacement between adjacent housing tubes.

Another object of the present invention is a flexible joint between adjacent downhole instrument housings that will protect the communication continuity of signal carriers between the adjacent housings.

Also an object of the present invention is a flexible joint between adjacent downhole instrument housings that is inexpensive to fabricate, assemble, service and repair.

A further object of the present invention is a flexible joint between adjacent downhole instrument housings having no need for a pressure compensation system to protect the insular environment around the signal carriers between the housings.

Broadly, the present invention comprises a flexible, fluid impermeable sheath for enclosing signal carrying conduit that is threaded through a torque transmitting universal joint. The universal joint mechanically links two adjacent housings of an articulated instrument. The housings are long tubes for encapsulating electronic components and circuitry. Two embodiments of the invention provide an enclosed passageway between the adjacent housings for threading the signal carriers. The passageway comprises a flexible wall tube having considerable radial strength such as a bellows or hydraulic fluid power conduit. A third invention embodiment encapsulates the carrier conduits with an elastomer that is molded within a relatively thin, fluid impermeable sheath The sheath has a fluid tight connection at opposite ends to respective housings.

The mechanical joint of the present invention comprises a Cardan type of universal joint wherein the meshed joint fingers of two joint bases are pivotally connected by an open ring spyder. Four spindles projecting in a common plane radially from the outer periphery of the ring pivotally secure each of the four meshed fingers. An open center area of the ring accommodates through passage of a flexible, substantially fluid impermeable signal carrier sheath between adjacently joined ends of the instrument housings.

In one embodiment of the invention, the flexible sheath may take the form of a flexible, high pressure hose of the type commonly used for high pressure hydraulic systems. Hose for this purpose may be constructed with tubular walls that are reinforced with braided or woven steel wire. Opposite ends of the hose may be secured to respective ends of the adjacent instrument housings by traditional tubing nuts for a pressure tight connection around an aperture through the respective housing end walls. The hose is threaded through the open center of the universal joint spyder ring and the signal conduit are threaded through the open hose channel.

In another embodiment of the invention, the sheath comprises a cylindrical bellows having a high pressure mechanical attachment at opposite ends of the sheath to respective bore plugs. The bore plugs seal apertures through the respective housing ends for physical passage of the signal carrying conduits which may take the form of electrical wiring, optical communication fibers or fluid conduits. The signal carriers are the operationally unifying arteries between instrument components that are physically located within the spacial volumes enclosed by the tubular walls of the respective instrument housings. The signal carriers are threaded through an open passageway within the bellows. The bellows convolutions provide sufficient structural integrity to oppose a pressure collapse or penetration at low to moderate well depths and pressures. Hence, the assembly pressure within the bellows sheath is atmospheric and no downhole pressure compensation system is required.

Another embodiment of the invention, especially suitable for extremely high pressure, deep well applications, provides a flexible, fluid impermeable sheath for enclosing the signal carriers. In this embodiment, the sheath is also secured to the housing end walls with a fluid tight connection around an end wall aperture. However, the sheath also confines a substantially solid filler of flexible elastomer material such as silicone rubber that is injected into the sheath after the signal carriers are threaded through the sheath. This elastomer encases the signal carriers within the outer sheath.

A bore plug may be provided within each of the adjacent instrument housings inside of the first or outer bore plug. Linking signal carriers are connected at respective inner ends to a bulkhead gang-connector mounted within the interior plug and to a gang-connector mounted in the outer plug.

Preferably, the outer bore plugs are secured to opposite ends of the flexible sheath that joins them as a singular unit. Additionally, the outer plugs are conveniently removable from the housing end bores to facilitate separation and disconnection of the singular unit from either or both of the housings.

The universal joint of the present invention requires little force to deflect since the flexing structure carries no load except the borehole pressure. Additionally, the invention provides azimuth alignment between the top and the bottom modules and prevents relative rotation or axial displacement about the (Z) axis. Since the universal joint of the present invention does not require a separate pressure compensation section, the joint may be made with minimum length. Cardan universal joints require little force to deflect since the flexible element in the joint carries no external pressure load except for the borehole pressure.

BRIEF DESCRIPTION OF THE DRAWINGS

For a thorough understanding of the present invention, reference is made to the following detailed description of the preferred embodiments, taken in conjunction with the accompanying drawing wherein like reference characters designate like or similar invention elements and wherein.

DESCRIPTION OF THE PREFERRED EMBODIMENTS

Figure 1:
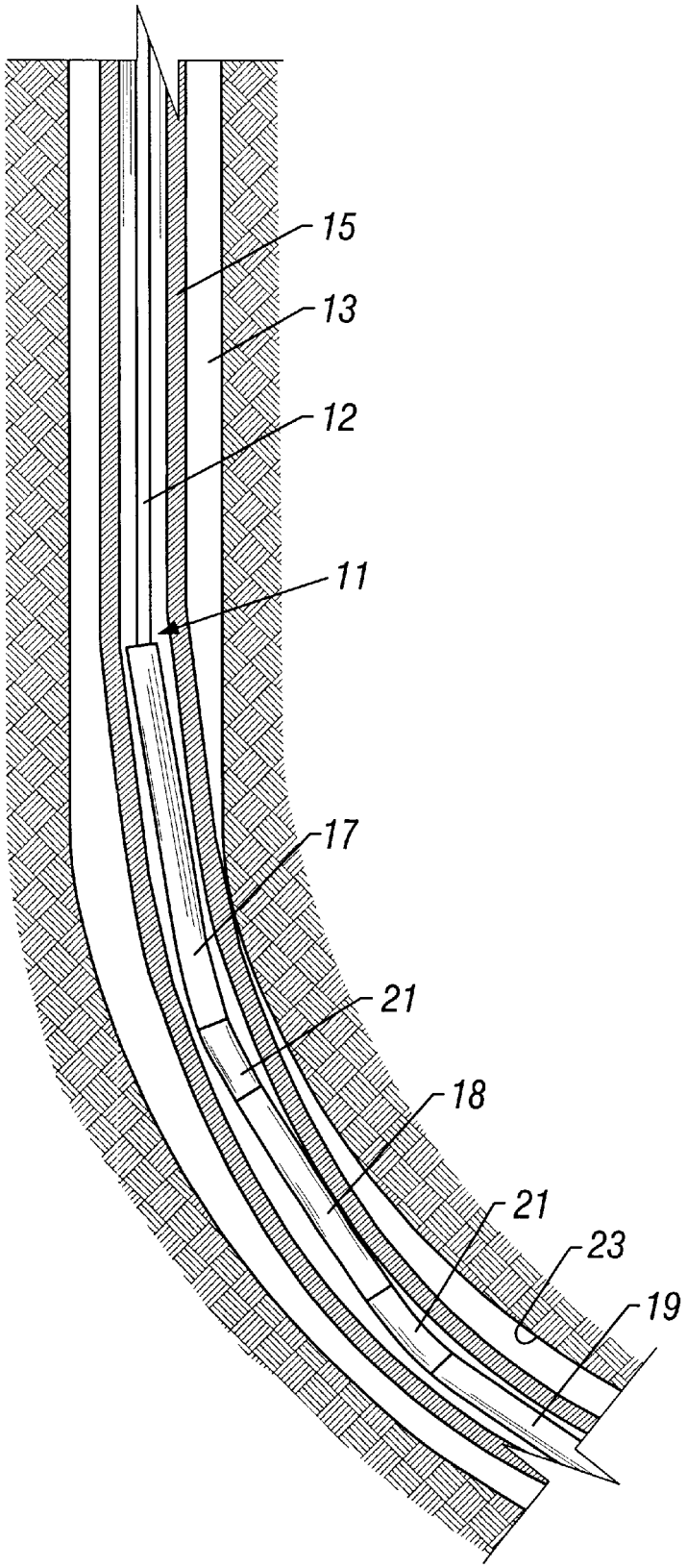
FIG. 1 is a schematic view of a well with a curved portion and a downhole tool with flexible joints that are constructed in accordance with the invention.

Referring to the utility environment of the present invention represented by FIG. 1, a downhole measurement tool 11 for use in a well 13 is shown. For example, the tool 11 may be lowered into well 13 through the interior fluid flow bore of a drill pipe 15 at the end of a wireline 12. Power may be supplied to the tool 11 along an electrical conductor combined with the wireline 12. The wireline 12 also comprises communication conduit by which the tool 11 transmits or receives coded data signals to or from the surface. Optionally, the tool may be battery powered or powered in situ by the circulation of drilling fluid through a generator or alternator.

Tool 11 comprises two or more measurement modules 17, 18 and 19 which are joined together with an articulated linkage 21 of the type that is often characterized as a universal joint. Typically, each module is a tubular shell that is sealed fluid-tight at opposite ends. Electronic components and circuitry is housed within the volume enclosed by the tubular shell. Linkage 21 is provided to enable the tool 11 to bend or flex a limited amount between modules 17, 18 and 19 when a curved portion 23 of well 13 is encountered. The length and number of measurement modules 17, etc., depends upon the volume requirements of the instrument components, the inside diameter of the drill string bore and the radius of the smallest well bore curve to be encountered. However, since the tool 11 is, operationally, a single unit, the several modules 17, 18 and 19 must communicate: either electrically, optically or hydraulically. In many cases, all of the modules must maintain a substantially consistent angularity about the longitudinal axis and/or must maintain a substantially fixed overall length.

Figure 2:
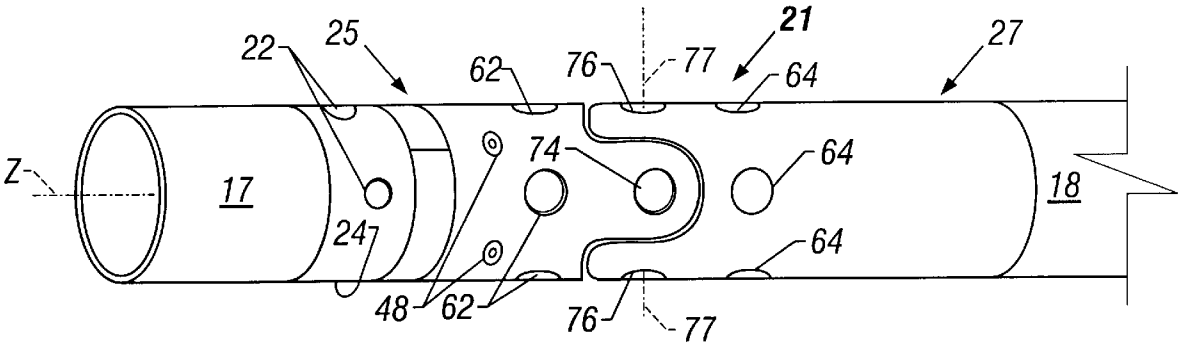
FIG. 2 is an isometric view of the universal joint invention.
Figure 3:
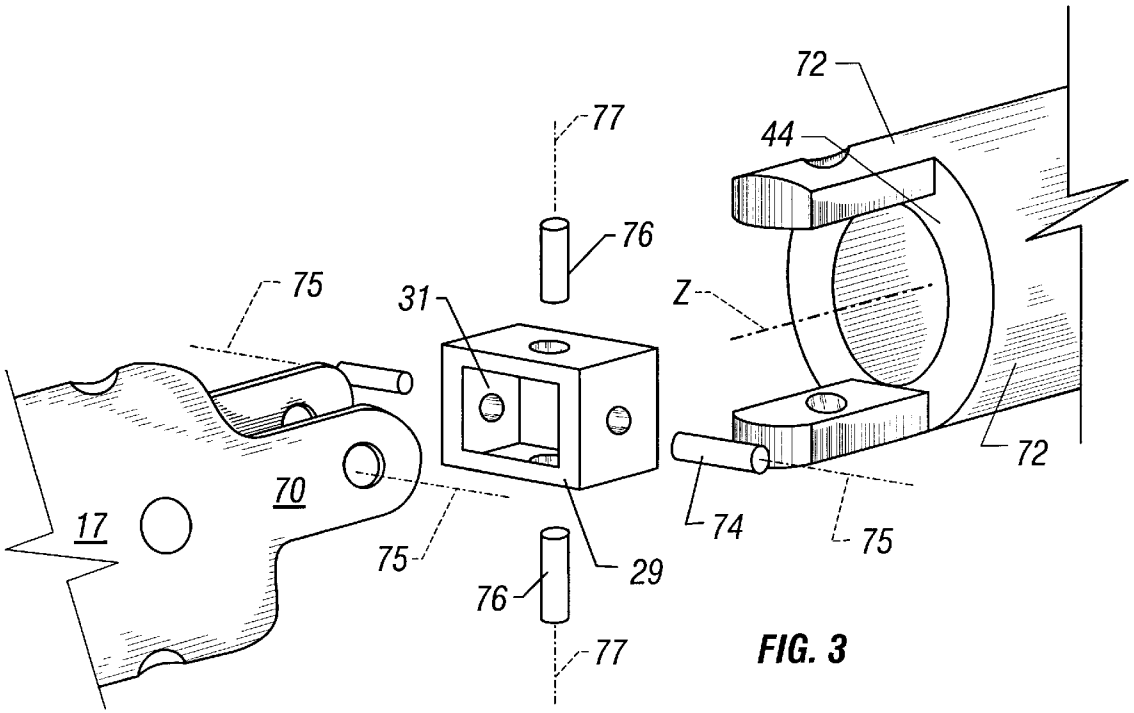
FIG. 3 is an exploded assembly view of the invention.

With respect to FIGS. 2 and 3, the preferred universal joint 21 for this invention is that of the Cardan type comprising a top sub 25, a bottom sub 27 and a spyder ring 29. A pair of parallel finger elements 70 project longitudinally from the base of top sub 25. A corresponding pair of finger elements 72 project longitudinally from the base of bottom sub 27. The finger elements 70 are pivotally joined to the spyder ring 29 by journal pins 74 for articulation about the axis 75. Finger elements 72 are pivotally secured to the spyder ring 29 by journal pins 76 for articulation about the axis 77. The axes 75 and 77 are substantially perpendicular within the same plane. The journal pins 74 and 76 may be traditional pin and box joints wherein the pins 74 and 76, for example, are secured non-rotatively to the outer perimeter of the spyder ring 29 to project outwardly in the manner of a spindles. The pin 74 and 76 projections rotatively fit within respective sleeves set within the mating fingers 70 and 72. The OD surfaces of the pins 74 and 76 slide within the ID surfaces of the respective sleeve bores. Those of ordinary skill in the art will recognize that the pin and box joint described heretofore may be alternatively replaced by a spindle and bearing joint. Moreover, the pin or spindle may be secured to either the spyder ring 29, the fingers 70 or 72 or secured to neither. An equivalent design provides bearings or journal sleeves in both, the spyder ring 29 and the fingers 70 and 72 with an independent pin bridging both bearings or sleeves.

Operatively, the bottom sub 27 may be rotated, with the spyder ring 29, about the axis 75 relative to the top sub 25. In this movement plane, the pins 76 are non-rotating link pins. Alternatively, the bottom sub 27 may be rotated about the axis 77 relative to the top sub 25. In this movement plane, the pins 74 are non rotating link pins. Both rotations may occur simultaneously. However, the joint does not axially elongate nor does any significant angular displacement about the longitudinal Z axis of the tool 11 occur.

The spyder ring 29 is a structural perimeter around an open center space 31. The substance of the perimeter may be square, round or any other convenient shape. The spyder ring provides a rigid structural base to rigidly unify the pins 74 and 76. The open center space 31 accommodates the signal carrier sheath 40, for example.

Within the body of the subs 25 and 27, axially internal of the finger projections, are respective cavities 66 and 68 that are vented by wash ports 62 and 64. The cavities 66 and 68 are preferably open to the spyder center space 31.

Figure 4:
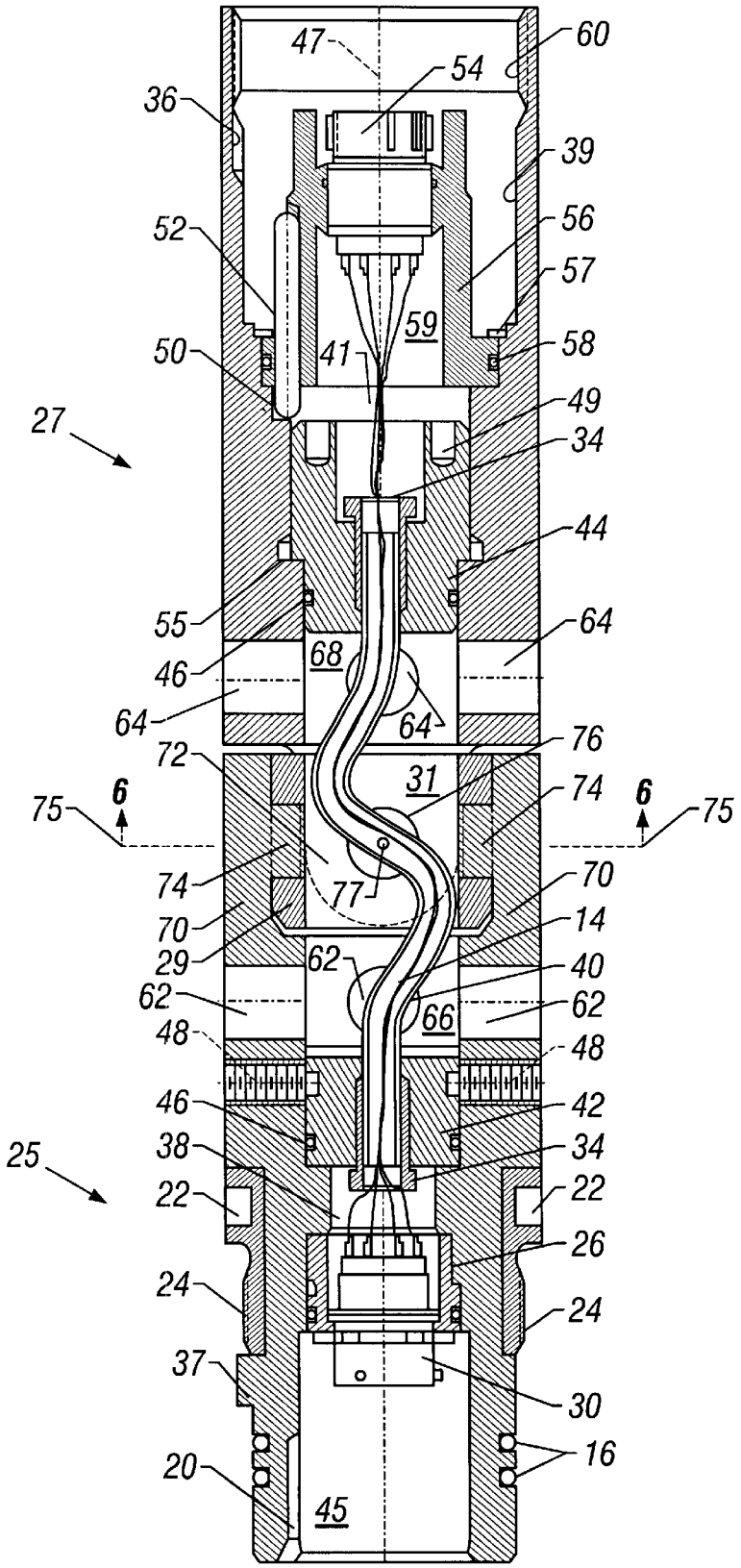
FIG. 4 is a longitudinal cross-section of a first embodiment of the invention.

Referring to FIG. 4, the top sub 25 is mechanically secured to the tubular housing of module 17, for example, by a split collar 24 that may be freely rotated around a channel in the perimeter of the sub 25 end plug. The split collar 24 carries machine threads that are rotatively advanced into mating internal threads in the module 17. The split collar is torqued into position by a spanner wrench having pins that mesh into pin sockets 22.

Fluid and pressure sealing O-rings 16 around the outer surface of the top sub end plug provide environmental protection to the module 17 interior and the instruments and electronic components within the module 17. Angular orientation of the top sub 25 relative to the instrument module 17 is maintained by an external key tab 37 and an internal keyway 20 that mesh with matching elements on the module housing.

A connector adapter 26 is secured within a counterbore of the top sub structure with a sealed and angularly restrained fit. This adapter 26 provides a fluid and pressure tight panel interface for the top conduit connector 30.

An outer plug 42 in the counterbore of the top sub, sealed by O-ring 46 and secured by threaded lock pins 48, provides a second transverse pressure wall in the inner bore of the top sub 25. The axial chamber space 38 between the outer plug 42 and the cable connector 30 is initially sealed under atmospheric pressure. One end of a length of high-pressure hydraulic hose 40, for example, is secured through the outer plug 42 by a compression nut 34 to house the atmospheric channel 14. The bottom end of the hose 40 is secured through the outer plug 44 of the bottom sub 27 by compression nut 34.

The hose 40 comprises an exterior sheath with an internally open, atmospheric pressure channel 14 between the top sub 25 and the bottom sub 27. Typically, the hose suitable for this purpose is constructed with layers of fabric and braided or woven steel wire bound in an elastomer such as rubber.

The bottom sub 27 has, for example, a machined thread 60 and a seal surface 39 for making a mechanical connection to the instrument module 18 below the universal joint. A keyway slot 36 is formed in the bottom sub thread sleeve to set the angular orientation of the instrument module 18 relative to the universal joint and, hence, the upper instrument module 17.

The panel wall adapter 56 for the bottom sub conduit connector 54 makes a counterbore push-fit with the bottom sub structure that is sealed by an O-ring 58. The adapter 56 is axially confined by a snap ring 57. Angular orientation of the adapter 56 with the universal joint reference axis is maintained by a key 52 that meshes with a keyway 50.

Plug 44, sealed by O-rings 46, completes the sealed enclosure of the bottom sub chamber space 59. The plug 44 is axially secured between an abutment ledge 55 and a compression nut 49.

A multiple conductor electrical conduit harness 41 may be threaded through the atmospheric passage space 14 within the hose 40 between the chambers 38 and 59. Within either chamber 38 and 59, the conductor leads may be openly connected to the cable connectors 30 and 54. The cable connectors 30 and 54 provide a panel interface for cable bundles 45 and 47 of signal carriers. Conduits within each cable bundle are electrically connected to the module interior side of the connectors. Static connector leads potted within a heavy insulator plug provide signal continuity from the module interior into the chambers 38 and 59.

Figure 5:
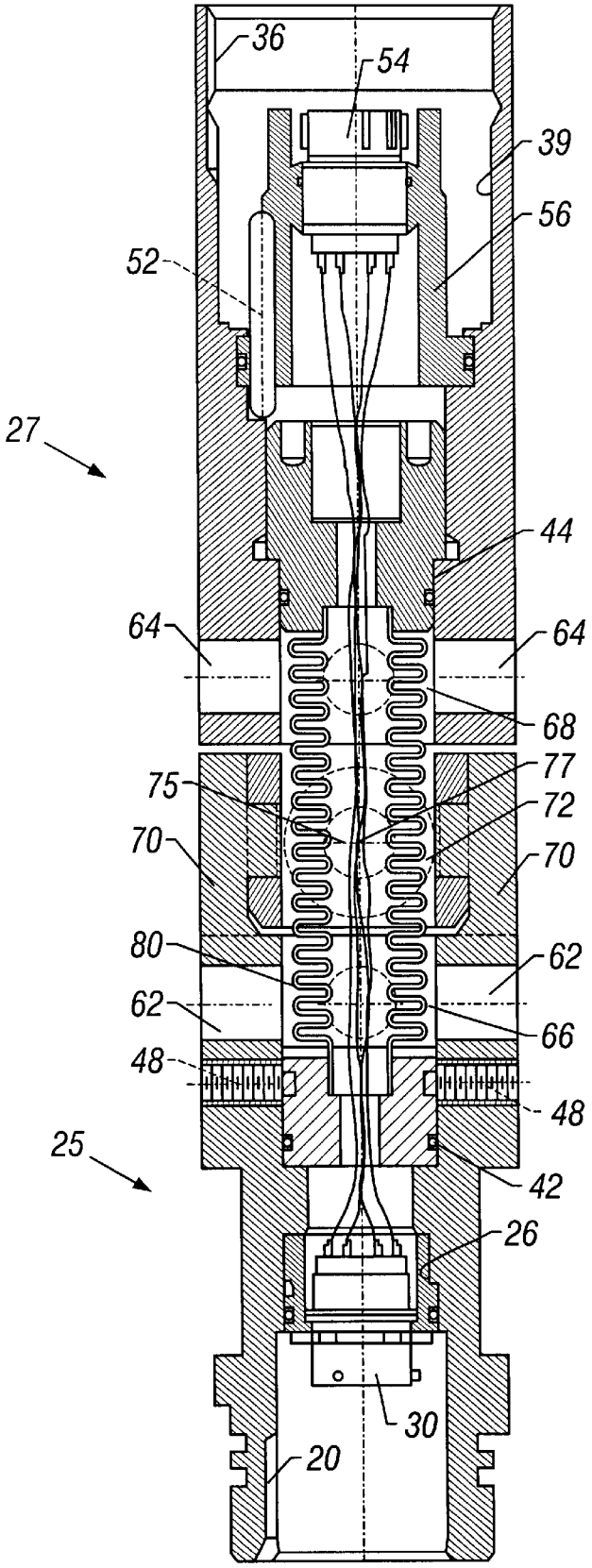
FIG. 5 is a longitudinal cross-section of a second embodiment of the invention.
Figure 6:
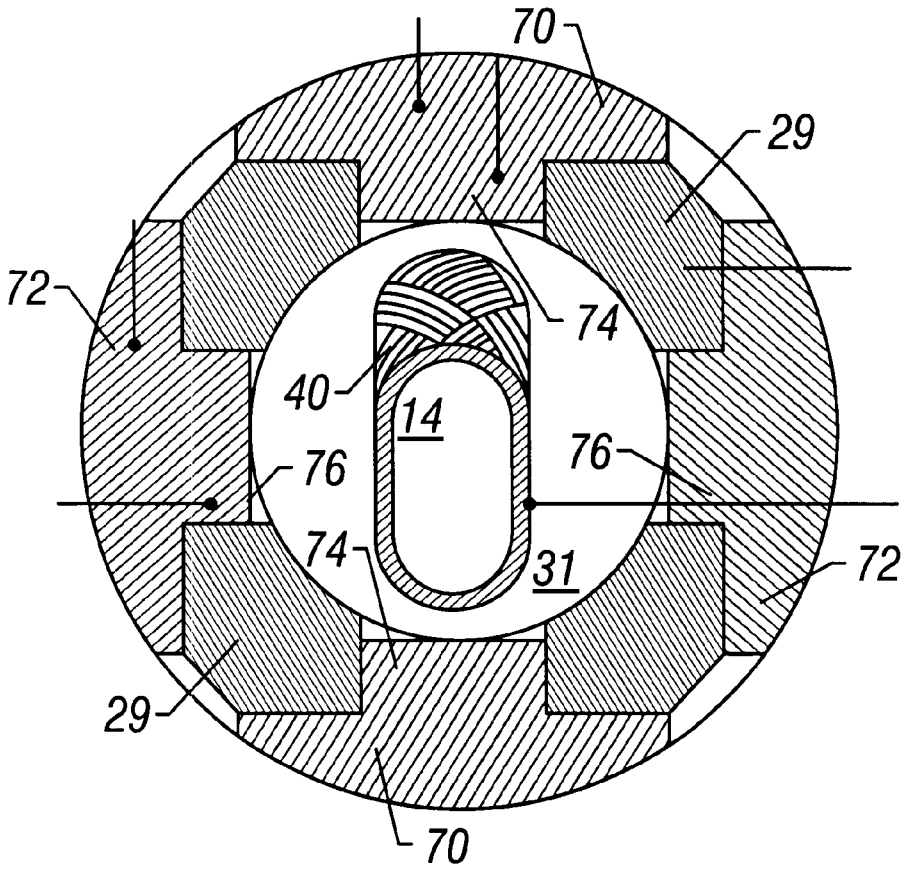
FIG. 6 is a cross-sectional view of the invention as seen into the cutting plane 6—6 of FIG. 4.

FIG. 5 illustrates an alternative atmospheric pressure passage space for housing the signal carrier conduits in the form of a fluid impermeable bellows 80 spanning between the top sub plug 42 and the bottom sub plug 44. The bellows ends may be welded or silver soldered, for example, to the plugs 42 and 44. Other connection methods may include flare nuts and compression collars not shown. Light tubes and hydraulic tubes as well as electrical conductors may be safely housed within the atmospherically open interior of the cylindrical bellows 80. The multiple convolutions of the bellows wall design have the potential for great external crushing pressure resistance imposed by standing well bore fluids at great depth.

Figure 7:
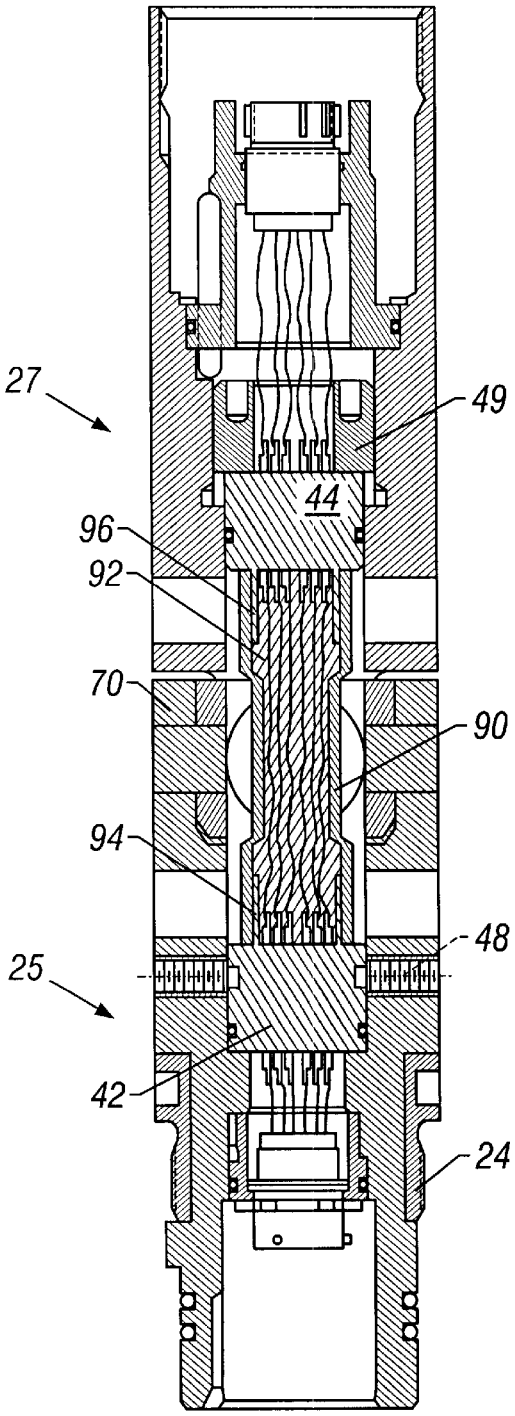
FIG. 7 is a longitudinal cross-section of a third embodiment the invention.

The FIG. 7 embodiment of the invention differs from the foregoing embodiments in that the signal carriers between the respective modules are encased within a resilient solid filler 92 such as silicon rubber in lieu of an atmospheric pressure passageway. This FIG. 7 embodiment provides an elastomer boot or sleeve 90 between the respective bore plugs 42 and 44. The signal carriers are threaded through the sleeve 90 prior to filling the internal volume of the sleeve with silicon, for example. After the signal carriers are threaded between the sleeve ends and connected to the potted conductors in the bore plugs 42 and 44, the ends of the sleeve 90 are secured to an internal mandrel 94 by clamping, molding, vulcanizing or heat shrinking, for example. In many cases, it may be more desirable to mechanically clamp the boot ends onto the internal mandrels. Finally, the sleeve internal volume is filled by injection with a resilient solid compound such as silicon rubber to encapsulate the signal carriers within a pliable, insulated potting. After the filler cures, it remains flexible and pliable. As a solid, however, the filler is substantially incompressible and hence will not collapse onto the signal carriers under extreme pressure. Moreover, The solid nature of the filler is continuous. Should the filled sheath be severed, or penetrated, in situ well fluid cannot enter the inner volume of the instrument housing due the solid plug nature of the filler.

Figure 8:
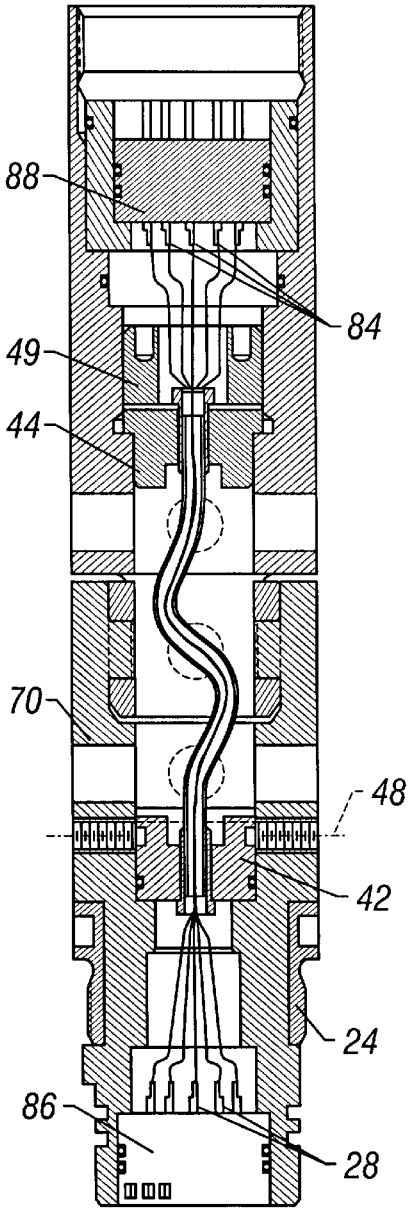
FIG. 8 is a longitudinal cross-section of an embodiment of the invention having a high pressure-feed through connector

FIG. 8 embodiment of the invention suggests the use of high pressure internal bore plugs 86 and 88 as electrical feed-through connectors for the embodiments similar to those of FIGS. 4 and 5. Conduit connectors 30 and 54, such as is represented by the illustrations, are more suitable for low to moderate pressure environments. For higher pressure environments, it is preferable for the feed-through conductors 82 and 84 to be molded or potted into a close tolerance plug element that is sealed within a receptacle bore by double O-rings.

Although a Cardan type of universal joint 21 has been disclosed as the preferred embodiment of the present invention, it should be understood that there are several, substantially equivalent universal joint styles such as the ball and socket joint or the constant velocity joint. The Cardan joint is strong, durable, relatively inexpensive, easy to repair and maintain and is available from numerous sources worldwide. However, it does have some minor operational eccentricities that may be avoided by joints of other design. On the other hand, however, those alternative designs carry endemic design flaws of their own.

The invention has been described in terms of specified embodiment which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A downhole instrument assembly comprising: a pair of elongated instrument housings having instrument components within respective interior volumes; adjacent ends of said housings being linked by a torque transmitting articulation joint; apertures through the adjacent housing ends into said interior volumes; a substantially fluid-tight seal of each of said apertures; signal carriers routed through said apertures and said articulation joint for operatively linking instrument components in respective interior volumes; and, a flexible sheath surrounding said signal carriers between sealed penetrations of said apertures, a wall of said sheath having structural properties of fluid impermeability and strength to oppose a fluid pressure differential collapse of said walls against said signal carriers.

2. A downhole instrument assembly as described by claim 1 wherein said flexible sheath confines substantially atmospheric pressure within said wall.

3. A downhole instrument assembly as described by claim 2 wherein said flexible sheath is a section of high-pressure tubing.

4. A downhole instrument assembly as described by claim 3 wherein said signal carriers are routed through an open center section of said high-pressure tubing.

5. A downhole instrument assembly as described by claim 2 wherein said flexible [fluid impermeable] sheath is a section of bellows.

6. A downhole instrument assembly as described by claim 5 wherein said signal carriers are routed through an open center section of said bellows.

7. A downhole instrument assembly as described by claim 1 wherein said flexible sheath strength is substantially created by an elastomer filling of void space within said wall.

8. A downhole instrument assembly as described by claim 7 wherein said elastomer filling substantially encases said signal carriers.

9. A downhole instrument assembly as described by claim 1 wherein said articulation joint is a Cardan universal joint.

10. A downhole instrument assembly as described by claim 1 wherein said articulation joint comprises an open center spyder ring, said signal carriers and sheath being threaded through the open center of said spyder ring.

11. A downhole instrument assembly as described by claim 7 wherein the open center of said spyder ring is flushed by wellbore fluid.

12. A downhole instrument assembly as described by claim 1 wherein said signal carriers are electrically conductive.

13. A downhole instrument assembly as described by claim 1 wherein said signal carriers are light conductive.

14. A downhole instrument assembly as described by claim 1 wherein said signal carriers are fluid conductive.

15. A downhole instrument assembly as described by claim 1 wherein said seals and sheath are removable from said apertures as a singular unit.

16. A method of assembling a downhole instrument comprising at least two pivotally joined, elongated housing modules, said method comprising the steps of:

(a) connecting adjacent ends of said housing modules with a mechanical universal joint having substantially no relative elongation or twisting;

(b) penetrating the interior volumes of said housing modules by respective apertures;

(c) providing substantially fluid-tight seals for said apertures;

(d) providing a flexible sheath to surround said signal carriers between said aperture penetrations, walls of said sheath having structural properties of fluid impermeability and strength to oppose a fluid pressure differential collapse of said walls against said signal carriers; and, (e) threading instrument signal carriers through said sheath.

17. A method as described by claim 16 wherein said sheath encloses a gaseous atmosphere around said signal carriers.

18. A method as described by claim 17 wherein said gaseous atmosphere is confined within said sheath at approximately atmospheric pressure.

19. A method as described by claim 17 wherein said sheath is a section of high-pressure tubing.

20. A method as described by claim 19 wherein said signal carriers are routed through an open center-section of said high-pressure tubing.

21. A method as described by claim 17 wherein said sheath is a bellows section.

22. A method as described by claim 21 wherein said signal carriers are routed through a open center of said bellows section.

23. A method as described by claim 16 wherein said sheath encloses an elastomer filling.

24. A method as described by claim 23 wherein said elastomer filling substantially encases said signal carriers.

* * * * *